US006824091B2

(12) United States Patent
Inana

(10) Patent No.: US 6,824,091 B2
(45) Date of Patent: Nov. 30, 2004

(54) HOLDER DEVICE FOR RECORDING SHEET ROLL

(75) Inventor: Katsuya Inana, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/378,842

(22) Filed: Mar. 5, 2003

(65) Prior Publication Data

US 2003/0173451 A1 Sep. 18, 2003

(30) Foreign Application Priority Data

Mar. 12, 2002 (JP) ..... 2002-067518

(51) Int. Cl.[7] ..... B65H 75/24

(52) U.S. Cl. ..... 242/578.2; 242/578; 242/591; 242/596.4; 242/596.7

(58) Field of Search ..... 242/578, 578.2, 242/591, 596.7, 596.4, 599.3

(56) References Cited

U.S. PATENT DOCUMENTS 1,663,836 A * 3/1928 Hall ..... 242/586.5
2,107,020 A * 2/1938 Williams ..... 242/578.2
3,145,943 A * 8/1964 Grant ..... 242/538.2
3,411,734 A * 11/1968 Greenberg et al. ..... 242/578.2
4,129,266 A * 12/1978 Masiello ..... 242/598.6
4,191,342 A * 3/1980 Reinhold ..... 242/599.3
5,551,647 A * 9/1996 Browning ..... 242/578.2
6,230,999 B1 * 5/2001 Tanaka ..... 242/578.2
6,402,085 B1 * 6/2002 Smith ..... 242/578

FOREIGN PATENT DOCUMENTS

JP 7-223759 8/1995

* cited by examiner

*Primary Examiner*—Kathy Matecki
*Assistant Examiner*—Sang Kim
(74) *Attorney, Agent, or Firm*—Sughrue Mion, PLLC

(57) ABSTRACT

A pair of support members provided in a feeding part may selectively contain plural types of recording sheet rolls having different widths. In order to mount the recording sheet roll, the first and the second holders are attached to both ends of the recording sheet roll. Each holder is provided with positioning grooves to decide the position of the recording sheet roll in the axial direction. A support member of the first holder is provided with one groove, while the support member of the second holder is provided with two grooves corresponding to the width of recording sheet rolls. The support member is provided to be able to expand and contract in the direction of the width of the recording sheet roll, and by the expansion and contraction, the groove is adjusted so as to meet the support member in accordance with the widths of recording sheet rolls.

12 Claims, 4 Drawing Sheets

HOLDER DEVICE FOR RECORDING SHEET ROLL

BACKGROUND OF THE INVENTION

1. Field of the Invention

The present invention relates to a holder device for movably holding a recording sheet roll.

2. Description Related to the Prior Art

For a photographic printer and a color thermal printer, a recording sheet roll is used and cut into a sheet in predetermined sizes after printing. The recording sheet roll has a long recording sheet wound about a hollow core made of paper or plastic.

In order to mount the recording sheet roll in a feeding part of the printer, a holder device for a recording sheet roll, composed of a pair of holders, is set to both ends of the recording sheet roll. A pair of support members is fixed in the feeding part of the printer for supporting each holder, to which the recording sheet roll is mounted. The recording sheet roll is rotatably held by each holder, which is set in slits formed on the support members. In detail, each holder is composed of a fitting part to fit into the internal circumference of the core, a flange to press the lateral end of the recording sheet roll, and a shaft, that is inserted into the slits to rotatably hold the recording sheet roll. A positioning groove to fit the slits of the support member is provided in the shaft to decide the position of the recording sheet roll in the widthwise direction.

A variety of recording sheet are provided, and they often have different widths. The positioning groove and the slit do not meet each other if the width of the recording sheet roll is changed, since the distance between the holders are changed accordingly. Measures taken against such problem include using plural holders corresponding to the various widths of the recording sheet rolls. Alternatively, Japanese Patent Laid-Open Publication Number H7-223759 discloses a spacer that fits into the core of the recording sheet roll. By applying and removing the spacer, the holder may correspond to plural types of recording sheet rolls with different widths.

However, it is inconvenient for a user to select the right holder or the right spacer among plural holders or spacers in accordance with the width of the recording sheet roll. In addition, if the user makes a wrong choice of the holder or the spacer, the user is required to remove the holder or the spacer from the recording sheet roll and to attach the right holder or the right spacer, and that is a burden for the user.

SUMMARY OF THE INVENTION

An object of the present invention is to provide a holder device to which plural recording sheet rolls with different widths are easily mounted.

In order to achieve the above object, the holder device for holding a recording sheet roll comprises a first and a second holder members supported by a pair of support members, the first holder member has a first fitting part for one end of the recording sheet roll and a first shaft to rotatably support the first fitting part. On the first shaft, plural positioning grooves along the direction of the rotation axis of the first fitting part. One of the positioning grooves is fit into the support member in accordance with the width of the recording sheet roll.

The second holder member has a second fitting part fitted into the other end of the recording sheet roll, and a second shaft to rotatably support the second fitting part. One engaging groove is formed on the second shaft to fit into the support member. The second shaft is shiftable between a first position and a second position. At the first position, the engaging groove is the farthest from the fitting part. The engaging groove is the nearest to the fitting part at the second position. The second shaft to engage with the support member gets closer to the second position as the recording sheet roll becomes wider.

The second shaft has a substantially conical-shaped guide part that is pressed by the support member to shift the second shaft toward the second position. The second shaft may be biased toward the first position by an elastic member provided between the second fitting part and the second shaft. In order to facilitate attachment of the holder members to the support members, the positioning groove and the engaging groove are different in depth.

In the preferred embodiment, two positioning grooves are formed on the first shaft to selectively support a narrow recording sheet roll and a wide recording sheet roll. The second shaft is located at the first position when the narrow recording sheet roll is attached to the holder members, while the second shaft is at the second position when the wide recording sheet roll is attached.

BRIEF DISCRIPTION OF THE DRAWINGS

One with ordinary skill in the art would easily understand the above-described objects and advantages of the present invention when the following detailed description is read with reference to the drawings attached hereto.

PREFERRED EMBODIMENTS OF THE INVENTION

Figure 1:
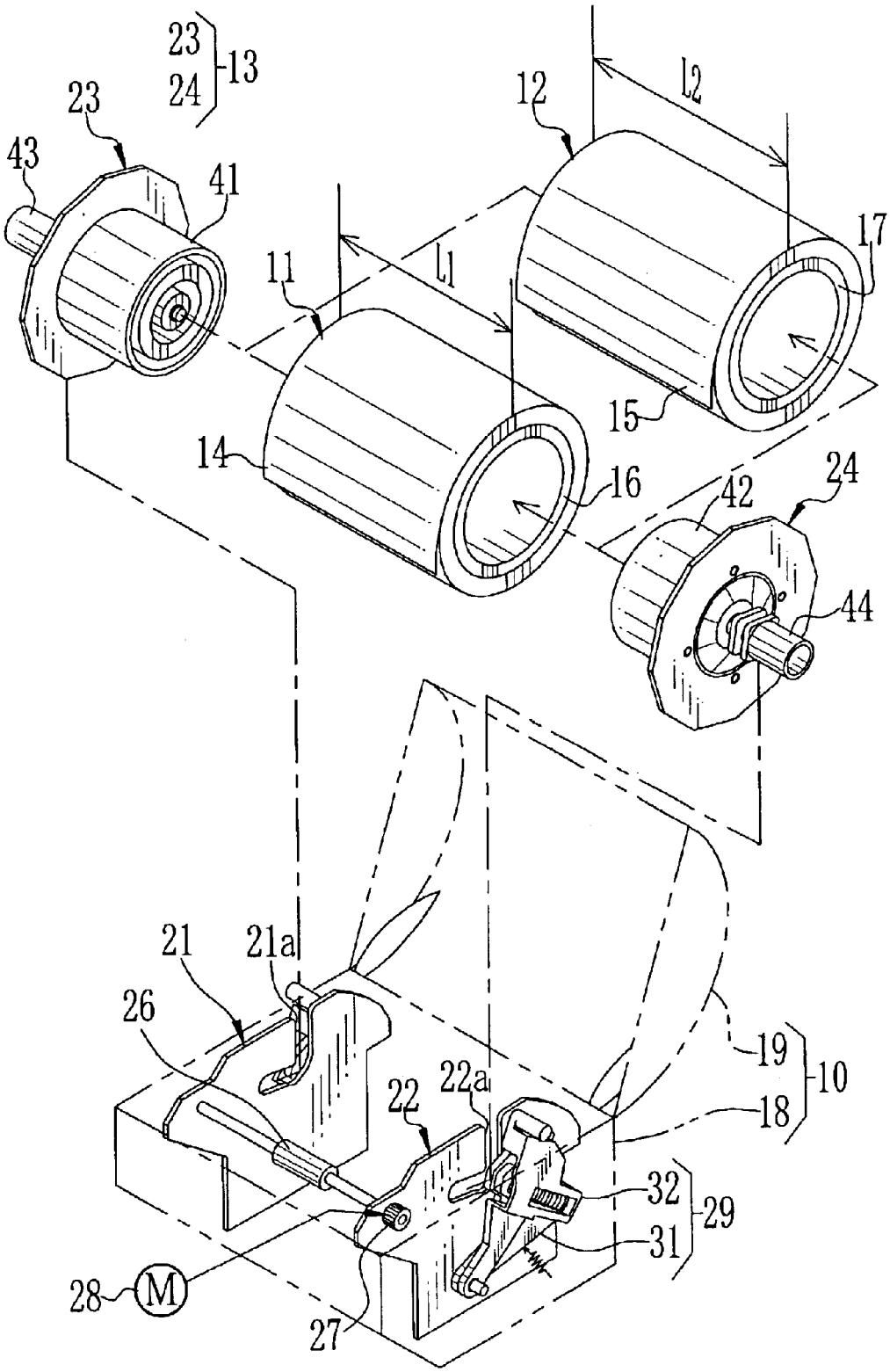
FIG. 1 is an explanation view of a holder device for a recording sheet roll and a feeding magazine.

As shown in FIG. 1, a feeding magazine 10 is a feeding device removably set in a printer to feed a recording sheet roll to a printing part. The feeding magazine 10 may selectively contain a recording sheet roll 11 having a narrow width and a recording sheet roll 12 having a wide width. In order to contain each recording sheet roll 11 and 12, holder devices for recording sheet roll 13 are fixed at both lateral ends.

The holder device 13 is composed of a pair of a first holder 23 and a second holder 24. Recording sheet webs 14 and 15 are respectively wound about hollow cores 16 and 17 in each recording sheet roll 11 and 12. The recording sheet 14 has a width L1 of 89 mm, while the recording sheet 15 has the width L2 of 100 mm for example.

The feeding magazine 10 is composed of a case body 18 and a lid 19. A pair of support members 21 and 22 is fixed in the case body 18. Nearly L-shaped slits 21*a* and 22*a* are formed in each support member 21 and 22. Each recording sheet roll 11 and 12 is rotatably held by each holder 23 and 24, which is fit into each slit 21*a* and 22*a*. The distance between each support member 21 and 22 is determined in accordance with the wide recording sheet roll 12.

A feeding roller 26 is provided in the case body 18. The peripheries of recording sheet rolls 11 and 12 are pressed against the feeding roller 26. The feeding roller 26 is driven through a driving gear 27 by a driving motor 28 provided in the printer, and the rotation of the feeding roller 26 rotates the recording sheet rolls 11 and 12. An opening (not shown) for feeding is formed in the lower front side of the case body 18, from which each recording sheet 14 and 15 is fed to the printing part.

Though the diameter of each recording sheet roll 11 and 12 becomes smaller as used, the rotational centers of them shift toward the feeding roller 26 as the recording sheet is drawn out, so that the peripheries of them touch the feeding roller 26 all the time. In order to enable such shift, the bottoms of each slit 21*a* and 22*a* are bent into the direction of the feeding roller 26 and movably hold each holder 23 and 24.

A pressing arm 29 is swingably provided on each supporting member 21 and 22 to press each recording sheet roll 11 and 12 against the feeding roller 26 by touching each holder 23 and 24. The pressing arm 29 is composed of a main arm 31 and a subsidiary arm 32.

Figure 2:
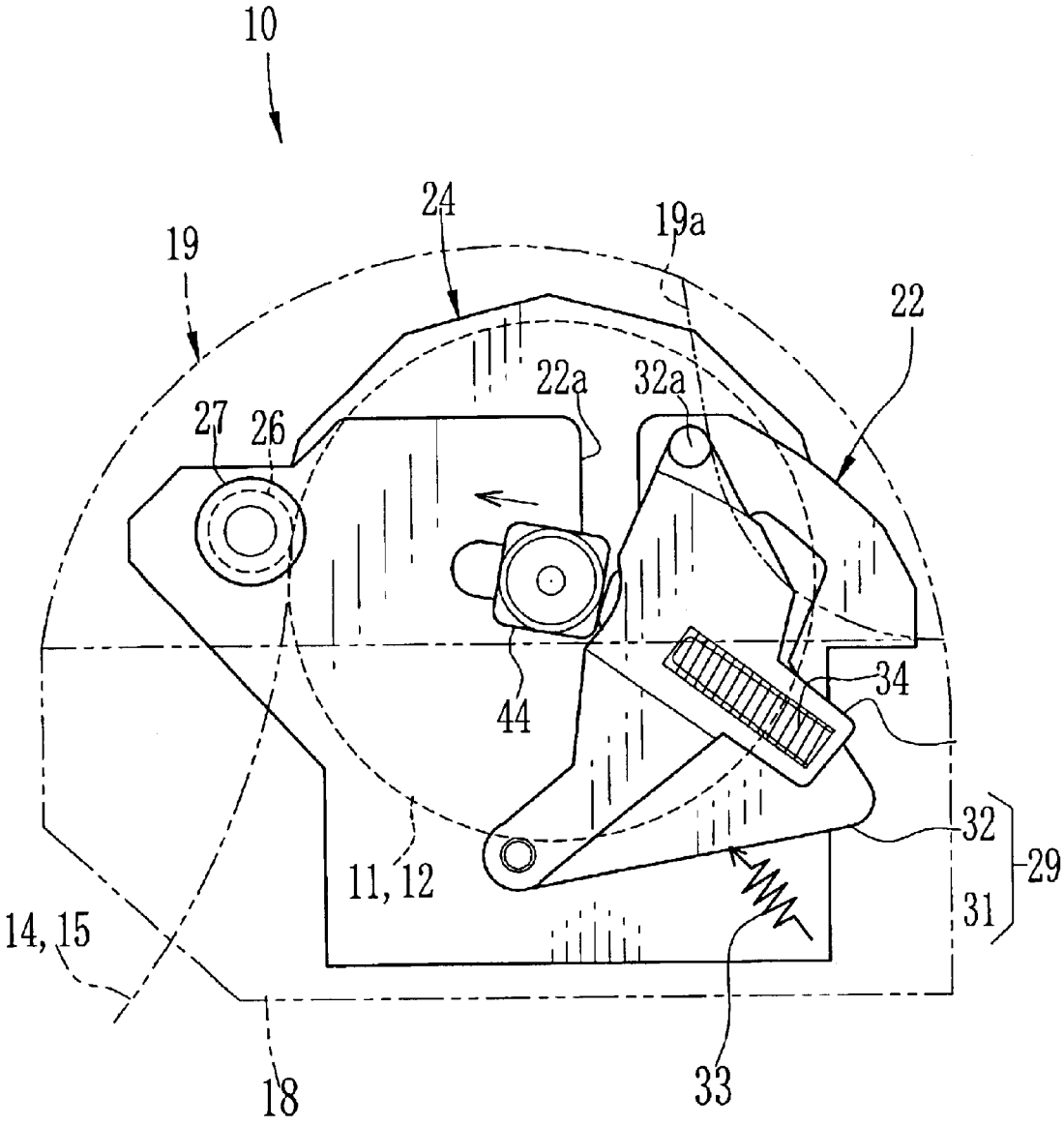
FIG. 2 is a side view of the feeding magazine.

As shown in FIG. 2, the main arm 31 is biased by a first spring 33 into the direction in which the holders 23 and 24 are pressed toward the feeding roller 26 (counterclockwise direction in the drawing.) The main arm 31 comes into contact with a stopper (not shown) to limit the rotation into the counterclockwise direction in the drawing. In order to set each holder 23 and 24 in the support members 21 and 22, each holder 23 and 24 is respectively inserted into each slit 21*a* and 22*a* by swinging the main arm 31 clockwise against the bias of the first spring 33.

One end of a second spring 34 is connected to the subsidiary arm 32. The other side of the second spring 34 is connected to the main arm 31 to bias the subsidiary arm 32 and the main arm 31 so that they are drawn away from each other. A pin 32*a* provided for the subsidiary arm 32 is pressed into the counterclockwise direction in the figure by a hitting section 19*a* formed on the lid 19 when the lid 19 is being closed.

When the lid 19 opens, the hitting section 19*a* of the lid 19 is separated from the pin 32*a* of the subsidiary arm 32. Therefore, the subsidiary arm 32 rotates into the clockwise direction in the figure (the direction for the second spring 34 to extend) by the bias of the second spring 34 and opens the slits 21*a* and 22*a*. In such condition, since only the main arm 31 covers the slits 21*a* and 22*a*, they are exposed when the main arm 31 is rotated into the clockwise direction in the figure against the bias of the first spring 33. Accordingly, each holder 23 and 24 may be easily set.

When the lid 19 is closed after the holders 23 and 24 are inserted into the slits 21*a* and 22*a*, the subsidiary arm 32 is pressed by the hitting section 19*a* of the lid 19 to rotate into the counterclockwise direction in the figure. Thereby, the second spring 34 is pressed and biases the subsidiary arm 32 to rotate into the clockwise direction in the figure. However, since the subsidiary arm 32 is limited to rotate to the clockwise direction by the lid 19, the second spring 34 biases the main arm 31 to rotate into the counterclockwise direction in the figure. Consequently, the main arm 31 is biased by both the first spring 33 and the second spring 34, and that increases pressures against the holders 23 and 24. Thereby, transmitting loss of rotary force caused by slipping may be prevented, since the recording sheet rolls 11 and 12 are pressed strongly against the feeding roller 26.

Figure 3A:
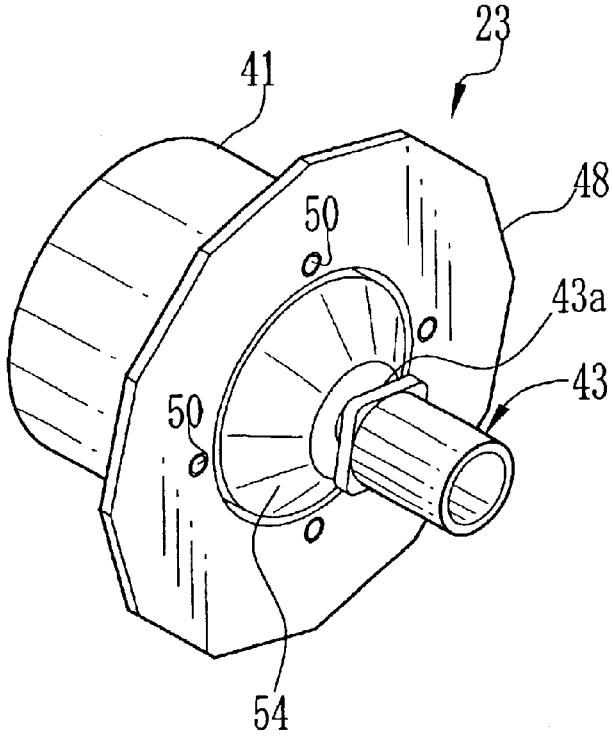
FIG. 3A is an outside view of a first holder.
Figure 3B:
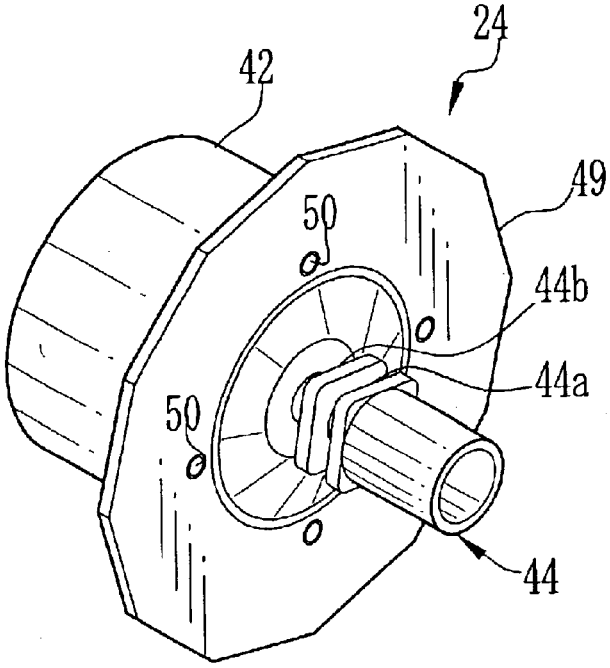
FIG. 3B is an outside view of a second holder.
Figure 4A:
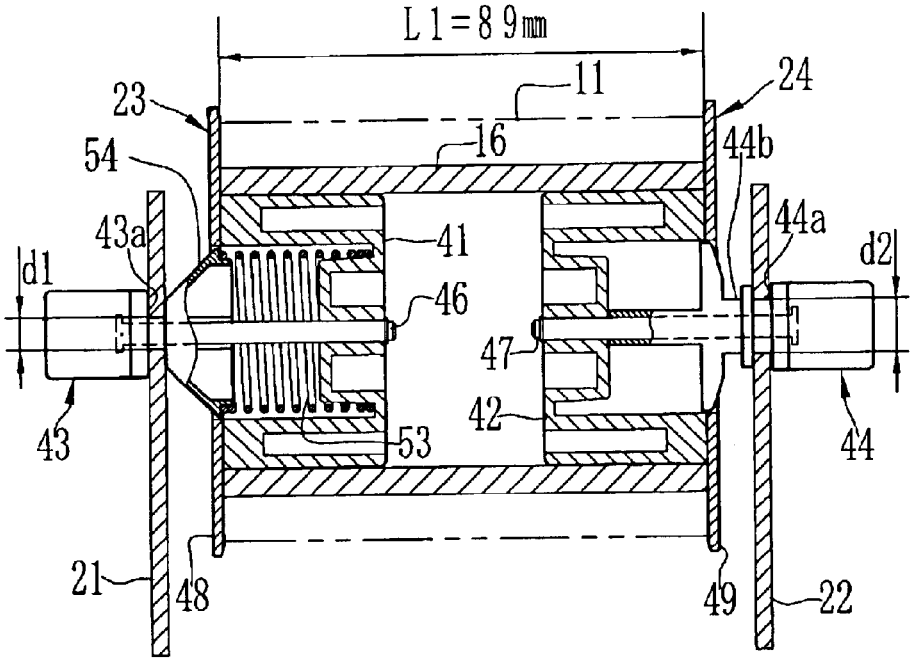
FIG. 4A is a cross-sectional view of the holder device wherein a recording sheet roll having a narrow width is mounted.
Figure 4B:
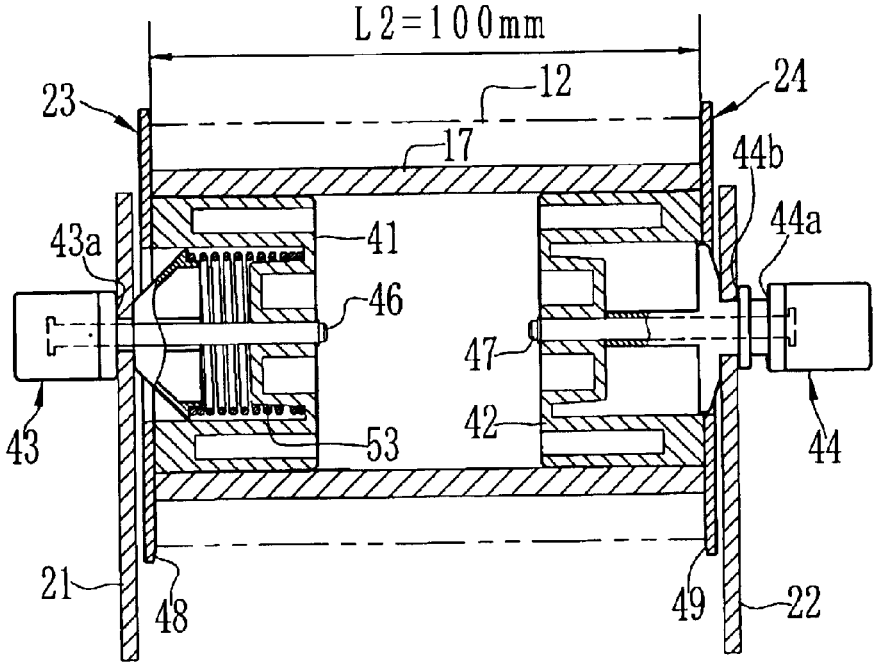
FIG. 4B is a cross-sectional view of the holder device wherein a recording sheet roll having a wide width is mounted.

As shown in FIG. 3A and FIG. 3B, each of the first holder 23 and the second holder 24 is respectively composed of fitting parts 41 and 42 to fit in the core 16 of the recording sheet roll 11 and the core 17 of the recording sheet roll 12, and shafts 43 and 44 for rotatably holding the fitting parts 41 and 42. The main parts of each holder 23 and 24 are made of plastic, for example. As shown in FIGS. 4A and 4B, metallic rotary shaft 46 and 47 are respectively inserted into the fitting parts 41 and 42 and the shafts 43 and 44. Each rotary shaft 46 and 47 rotates together with the fitting parts 41 and 42, and each shaft 43 and 44 rotatably supports the rotary shafts 46 and 47 respectively. Flanges 48 and 49 are attached to each fitting part 41 and 42 and fixed by pins 50.

In order to set the holders 23 and 24, each shaft 43 and 44 are inserted into each slit 21*a* and 22*a*, and thereby each recording sheet roll 11 and 12 is rotatably held. The shaft 43 and 44 have positioning grooves to decide the position of recording sheet roll 11 and 12 in the axial direction, parallel to the rotation axis of the recording sheet roll, by engaging with the support member 21 and 22. Grooves 44*a* and 44*b* are provided for the shaft 44 of the second holder 24. The groove 44*a* is fit into the slit 22*a* to mount the narrow recording sheet roll 11, while the groove 44*b* is inserted into the slit 22*a* to mount the wide recording sheet roll 12.

In the meantime, a groove 43*a* is provided for the shaft 43 of the first holder 23, which is able to expand and contract to the fitting part 41 into the axial direction of the recording sheet roll. The shaft 43 shifts into the axial direction between the first position (shown in FIG. 4(A)) wherein the groove 43*a* meets the slit 21*a* when the narrow recording sheet roll 11 is mounted, and the second position (shown in FIG. 4(B)) wherein the groove 43*a* meets the slit 21*a* when the wide recording sheet roll 12 is mounted.

A compression spring 53 is provided inside the fitting part 41. One end of the compression spring 53 connects with the fitting part 42 and the other end thereof connects with the shaft 43, which is biased toward the first position by the compression spring 53.

A substantially conical-shaped guide part 54 is provided for the shaft 43. The guide part 54 protrudes toward outside of the shaft and has a slope inclining from the periphery of the flange 48 to the center of the flange 48. When the wide recording sheet roll 12 is mounted, the guide part 54 is pressed by the support member 21 to shift the shaft 43 to the second position and to guide the groove 43*a* to the slit 21*a*.

Each shaft 43 and 44 has different thickness; for example, the diameter d1 of the shaft 43 is smaller than the diameter d2 of the shaft 44. The widths of each slit 21*a* and 22*a* are formed in accordance with the diameters d1 and d2 so as to prevent each holder 23 and 24 from being inserted into the wrong slits.

The following is an explanation about the function of constitution described above. When the recording sheet roll 11 having a narrow width is mounted in the feeding magazine 10, each holder 23 and 24 is fixed to both end of the recording sheet roll 11. While keeping that condition, the recording sheet roll 11 is placed between the support members 21 and 22. Since the shaft 43 of the first holder 23 is in the first position, the groove 44*a* of the second holder 24 meets the slit 22*a* when the groove 43*a* of the first holder 23 meets the slit 21*a*. While keeping each groove 43*a* and 44*a* respectly fixed in the slits 21*a* and 22*a*, the shafts 43 and 44 are inserted. After the pressing arm 29 rotates and the holders 23 and 24 are inserted into the slits 21*a* and 22*a*, the holders 23 and 24 are pressed against the feeding roller 26 by the biases of the first spring 33 and the second spring 34. Thereby, the recording sheet roll 11 is mounted in the feeding magazine 10.

A user cannot choose the grooves and will not be confused, as only one groove 43*a* is provided for the shaft 43 of the first holder 23. Additionally, even if the user mistakenly attempt to mount the groove 44*b* of the second holder 24 in the slit 22*a*, the recording sheet roll 11 will not be mounted, as the groove 43*a* of the first holder 23 does not match the slit 21*a*. Also, even if the user tries to insert each holder 24 and 23 in the wrong slits, the recording sheet roll 11 is not mounted, as the thickness of each shaft 43 and 44 and the widths of each slit 21*a* and 22*a* are different from each other respectively. Accordingly, the user may mount the recording sheet roll 11 in a right position without mistake.

In order to mount the wide recording sheet roll 12, the groove 44*b* of the second holder 24 is fit into the slit 22*a*. In that condition, since the shaft 43 of the first holder 23 is in the initial position (the first position), the groove 43*a* comes outside of the slit 21*a*, and the slit 21*a* meets the guide part 54. When the recording sheet roll 12 is placed in that condition, the support member 21 and the guide part 54 touch each other. When the recording sheet roll 12 is pressed into the feeding magazine 10, the shaft 43 shifts toward the second position by the function of the guide part 54, and the groove 43*a* is guided to the slit 21*a*. The shaft 43 is inserted into the slit 21*a* when the groove 43*a* meets the slit 21*a*. Thereby, the recording sheet roll 12 is mounted in the feeding magazine 10.

In the above case, even if the user mistakenly tries to set the groove 44*a* in the slit 22*a*, the groove 43*a* in the other side does not meet the slit 21*a*, as the distance between each support member 21 and 22 is determined in accordance with the width of the recording sheet roll 12. Consequently, the user may mount the recording sheet roll 12 properly without question.

Since the plural grooves are provided for one of the holders, plural recording sheet rolls having different widths may be mounted in the feeding magazine 10 without using a spacer or plural holder devices corresponding to the widths of the recording sheet rolls. In addition, the user may properly mount the recording sheet roll without considering the width of the recording sheet roll, as only one groove is provided for the shaft of each of the holders to be able to expand and contract in accordance with the width of the recording sheet roll. Also, since the shaft is biased so that the groove meets the support member with corresponding to the recording sheet roll having the shortest width, the recording sheet roll may be mounted easily.

Though the embodiment described above is an example wherein plural grooves are provided for the second holder, it is possible to provide plural grooves for the first holder as well. It is also possible to provide more than two grooves for the second holder so as to mount the recording sheet rolls having more than two different widths.

Additionally, though the shaft of the first holder is biased by the spring, the spring may be eliminated. Even without the spring, the user would not select the wrong groove, as the moving range of the shaft of the first holder is determined in accordance with the widths of recording sheet rolls. Though the shaft, into which the rotary shaft is inserted, does not rotate but instead the fitting part and the flange rotate in the above embodiment, all of them may rotate in the holder at the same time. In addition, the rotary shaft may be inserted into the slit without being covered, regardless of that the rotary shaft is covered with the shaft in the above embodiment. In that case, the rotary shaft works as a shaft, and the groove is formed by attaching the positioning members to the rotary shaft.

Additionally, the first and the second holders may be engaged with each other inside the core when they are attached to the recording sheet roll, so that each holder would not be dislocated. In that case, it is preferable to provide plural engaging positions in accordance with the widths of recording sheet rolls.

Furthermore, though the feeding magazine is removably set in the printer in the above embodiment, the holder device for recording sheet roll of the present invention may be used to mount the recording sheet roll in the feeding part of the printer. The rotational center of the recording sheet roll shifts toward the feeding roller in accordance with the thickness of core of the recording sheet roll in the above embodiment, though the present invention may also be applied to the recording sheet roll whose rotational center does not shift. In the above embodiment, the recording sheet roll is rotated by pressing the feeding roller and the peripheries of the recording sheet roll against each other. However, the present invention may also be applied if a driving gear is provided for the holder so as to rotate the recording sheet roll through the holder. Not only photographic paper or a thermal recording sheet but normal paper may be used as a recording sheet.

Various changes and modifications are possible in the present invention and may be understood to be within the present invention.

What is claimed is:

1. A holder device composed of a first balder member and a second holder member to rotatably hold a recording sheet roll, in which a recording sheet is wound into a roll, said first holder member and said second holder member are removably attached respectively to a first and second support member respectively, said second holder member comprising:

a second fitting part to be fit in one end of said recording sheet roll; and a second shaft to rotatably support said second fitting part, and plural positioning grooves to engage with said second support member, wherein said plural positioning grooves are arranged on said second shaft along the direction of the rotation axis of said second fitting part, and one of said plural positioning grooves is selected to engage with said second support member in accordance with the width of said recording sheet roll.

2. A holder device described in claim 1, wherein said first holder member comprises:

a first fitting part to be fit in the other end of said recording sheet roll; and a first shaft to rotatably support said first fitting part, wherein an engaging groove to engage with said first support member is formed on said first shaft.

3. A holder device described in claim 2, wherein said first shaft is shiftable between a first position wherein said engaging groove is in a farthest position from said first fitting part, and a second position wherein said engaging groove is in a closest position to said first fitting part, wherein said first shaft to engage with said first support member gets closer to said second position as said recording sheet roll becomes wider.

4. A holder device described in claim 3 further comprising:

an elastic member provided between said first fitting part and said first shaft, said elastic member biasing said first shaft toward said first position.

5. A holder device described in claim 3 further comprising:

a substantially conical-shaped guide part formed on said first shaft and pressed by said first support member when said first holder member engages with said first support member, to shift said first shaft toward said second position.

6. A holder device described in claim 2, wherein said positioning grooves and said engaging groove are different in depth.

7. A holder device to selectively support a first recording sheet roll wherein a recording sheet having narrow width is wound into a roll and a second recording sheet roll wherein a recording sheet having wide width is wound into a roll, said holder device having a first holder member and a second holder member being removably attached to a first and second support member respectively, said second holder member comprising:

a second fitting part to be fit in one end of said first recording sheet roll or said second recording sheet roll; and a second shaft to rotatably support said second fitting part, wherein a first positioning groove and a second positioning groove are arranged on said second shaft, said second positioning groove being provided between said first positioning groove and said second fitting part, said first positioning groove engaging with said second support member when said first recording sheet roll is mounted, said second positioning groove engaging with said second support member when said second recording sheet roll is mounted.

8. A holder device described in claim 7, wherein said first holder member comprising:

a first fitting part to be fit in the other end of said first recording sheet roll or said second recording sheet roll; and a first shaft to rotatably support said first fitting part, an engaging groove to engage with said first support member being formed on said first shaft, said first shaft being shiftable between a first position wherein said engaging groove is in a farthest position from said first fitting part and a second position wherein said engaging groove is in a closest position to said first fitting part, wherein said first shaft engages with said first support member in said second position when said second recording sheet roll is mounted.

9. A holder device described in claim 8 further comprising:

an elastic member provided between said first fitting part and said first shaft, said elastic member biasing said first shaft toward said first position; and a substantially conical-shaped guide part formed on said first shaft, said guide part being pressed by said first support member to shift said first shaft toward said second position when said first holder member, with said second recording sheet, roll engages with said first support member.

10. A holder device described in claim 8, wherein said first positioning groove and said engaging groove are different in depth.

11. The holder device described in claim 2, wherein said first and second support members are provided with L-shaped slits for receiving said first and second shafts.

12. The holder device described in claim 2, wherein said first and second shafts have different diameters.

* * * * *